United States Patent [19]

Poldervaart

[11] Patent Number: 4,568,295

[45] Date of Patent: Feb. 4, 1986

[54] SYSTEM FOR MAINTAINING A BUOYANCY BODY IN POSITION IN RELATION TO ANOTHER BODY

[75] Inventor: Leendert Poldervaart, La Turbie, France

[73] Assignee: Single Buoy Moorings, Inc., Fribourg, Switzerland

[21] Appl. No.: 502,732

[22] Filed: Jun. 9, 1983

[30] Foreign Application Priority Data

Jun. 9, 1982 [NL] Netherlands ..... 8202335

[51] Int. Cl.[4] ..... B63B 22/02

[52] U.S. Cl. ..... 441/3; 114/230

[58] Field of Search ..... 441/3, 4, 5, 21; 114/230, 231, 124, 125

[56] References Cited

U.S. PATENT DOCUMENTS

| | | | |
|---|---|---|---|
| 3,077,614 | 2/1963 | Lloyd | 441/3 |
| 3,155,069 | 11/1964 | Ross | 441/3 |
| 3,354,479 | 11/1967 | Koppenol | 441/5 |
| 3,899,990 | 8/1975 | Lecomte | 441/3 |
| 4,029,039 | 6/1977 | Van Heijst | 441/3 |
| 4,309,955 | 1/1982 | Kentosh | 114/230 |

FOREIGN PATENT DOCUMENTS

| | | | |
|---|---|---|---|
| 8202335 | 5/1974 | Netherlands . | |
| 7901416 | 9/1979 | Netherlands | 441/3 |
| 2019800 | 11/1979 | United Kingdom | 441/5 |

*Primary Examiner*—Trygve M. Blix
*Assistant Examiner*—Edwin L. Swinehart
*Attorney, Agent, or Firm*—Young & Thompson

[57] ABSTRACT

A system for maintaining a vessel in position with respect to another body such as a buoy by a rigid arm, the arm having a connection with the body and a movable cable connection with the vessel, the arm extends far above the bottom of the vessel preferably above the water surface and is loaded by a weight which is attached to the arm at a position between the ends of the arm or beyond the point of attachment of the connection.

6 Claims, 8 Drawing Figures

SYSTEM FOR MAINTAINING A BUOYANCY BODY IN POSITION IN RELATION TO ANOTHER BODY

The invention relates to a system for maintaining a buoyancy body, such as a vessel, in position and relation to another body, such as a buoy, a tower, a quay, etc., which position determining system comprises a stiff arm, connected to one of said bodies, for instance to the buoy etc., of which arm the other end is movably attached through a connection means to the other body, such as said vessel, which connection means is maintained under tension by means of a weight.

A system of this type is for instance known from the published Dutch Patent Application No. 7901416, especially FIG. 13.

In said known system an arm is used which is pivotably connected to the one body and of which the other end extending deep under water comprises a weight suspended from the other body through a cable, which other body should be maintained in position in relation to said first mentioned body. If said last-mentioned body is moving away from the desired position, then said weight is lifted, the cable suspending said weight will be oriented at an angle in relation to the vertical direction and the magnitude of said angle is determinative of the horizontal reset force component derived from said weight, which reset force component should function for bringing the drifting body back into position. In most cases a tanker has to be kept at a distance from a mooring buoy. The buoy and the tanker can be exposed to heavy movements and in this known system therefore the weight is positioned at a great depth underneath the bottom of the ship to take care that the weight is not touching the ship, not even in the situation in which the ship is moving towards said buoy.

Because of the great length of the cable carrying said weight, the dislocation of the ship should be relatively large to create a reset force component, which is able to oppose the disturbing forces and to bring the ship notwithstanding the great mass thereof back into position. Therefore said known system functions as a soft spring.

In my copending application Ser. No. 502,733, filed June 9, 1983, it was proposed to position the point of attachment of the arm with the weight biased connection means or cable at a higher level to convert said soft spring into a stiff spring. However, the weight thereby still remains at a great depth.

The object of the invention is now not only to eliminate the disadvantages of the soft spring, but also to transfer the weight from the position deep under water to another place.

Said object is achieved by the invention in that said weight is attached to the arm at a position between the ends of said arm or beyond the point of attachment of said connection means, whereby said point of attachment is far above the bottom of said vessel especially near the water surface. By means of the inventive proposal not only is the effective length of the connection means substantially shortened, so that a stiff spring is realized, but also the weight is moved upwards by positioning it on the arm. Positioning between the pivot connection of the arm to said one body and the point of attachment of the arm to said connection means creates a lever ratio which is less favourable than with the known connection of the weight to the end of the arm. However, the weight is positioned at a location eliminating conflicts with the ship, which location is completely accessible especially in the case in which the arm is completely above the water level. By furthermore making said weight relocatable, one gains the possibility to adjust the stiffness of the spring.

It is of course also possible to attach the weight beyond the point of attachment of the connection means and the arm on an arm extension in which case the lever ratio is more favourable.

A very simple solution is realized with two buoyancy bodies and anchorage by means of anchor chains the anchor chain turntable is supported by said arm or arms. In that case the chains form the weight or a part thereof.

If one uses anchor chains then within the scope of the invention a number of efficient embodiments is possible. It is possible that one buoyancy body is a buoy to which one or more arms are attached, whereby the turntable carrying the anchor chains is positioned on said arms or between said arms. It is also possible that a buoy is a cylindrical body with a horizontal longitudinal axis extending in the length direction of the arm or arms, however, it is also possible that the buoy comprises two cylindrical bodies parallel to each other and each having an arm rigidly attached thereto, between which arms the turntable for the anchor chains is attached.

The use of one cylindrical body as a buoyant body results in a buoy which is able to follow very easily the ship movements. Using two bodies results in a buoy with great stability of its own. In both cases the buoy is completely accessible from the ship.

If one uses two arms then these arms are preferably in a flexible way or through a universal joint connected to said one body and both arms are in a flexible way or through universal joints interconnected near the ends thereof by means of a transfer connection, whereby each arm carries a weight.

In all embodiments of the invention the arm or arms and/or the weights can be bodies which can be filled with ballast water or can be emptied. The result is a mooring system which in case of emptied ballast spaces has a buoyancy capacity so that it is very easy to accomplish the connection with the ship to be moored, after which by filling ballast water the desired weight is created for maintaining said ship in position.

It is remarked that the British Patent Specification No. 3,155,069 describes a buoy having a bifurcated arm connected thereto and rotatable around a vertical axis, which arm carries a weight. The ends of said arm are by means of mooring cables connected to the ship which is furthermore through a bow cable connected to said weight which is swingable around a horizontal axis. Thereby, however, said weight does not have any effect through said arm and through the mooring cables on the ship, but only through said bow cable.

The invention will be explained in more detail with reference to the drawings.

Figure 1:
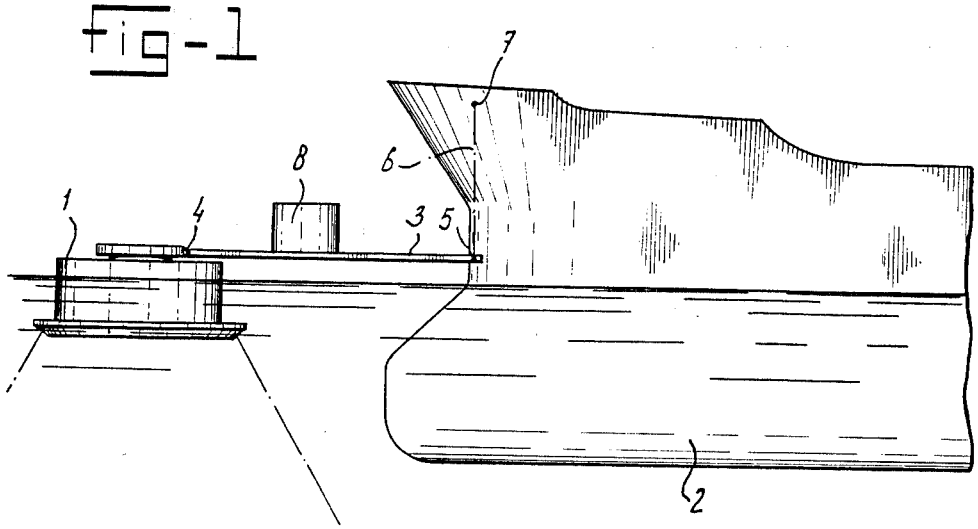
FIG. 1 illustrates schematically a side-view of the principle on which the invention is based.

FIG. 1 illustrates a fixed position body 1, such as a quay or tower, and a thereto moored ship 2. Said ship is kept at a distance from the quay 1 by means of one or more arms 3, of which one end is at 4 pivotable around a horizontal axis, attached to the body 1 and of which the other end 5 is pivotably attached to a connection means 6, which may have the form of a cable, a chain or rod, at the upper end 7 of which connection means is pivotably attached to the ship 2. A weight 8 is positioned on said arm or arms under the influence of which in the connection means 6 a tensile force is created from which reset force component is derived in case the ship 2 is dislocated in relation to the body 1.

Figure 2:
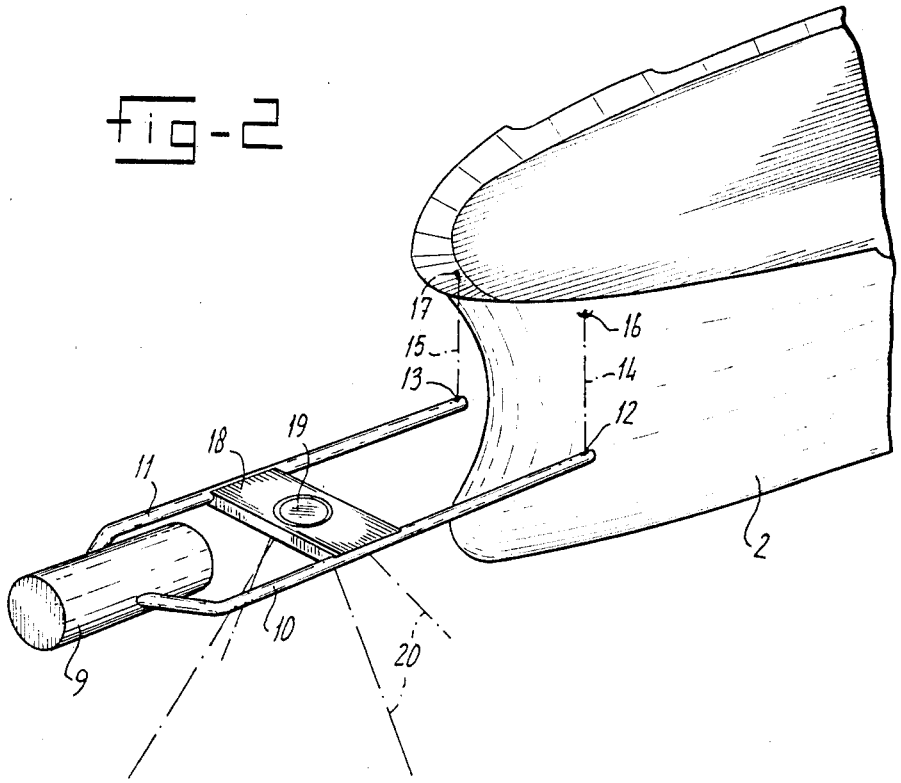
FIG. 2 is a perspective view of an embodiment.
Figure 3:
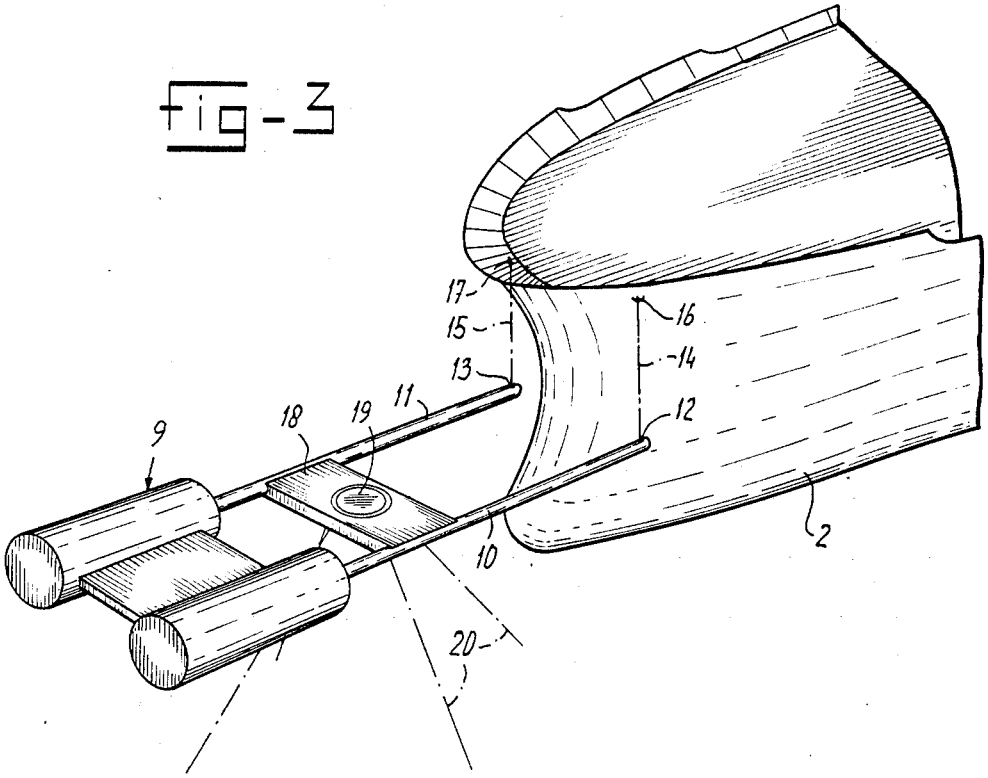
FIG. 3 is a perspective view of another embodiment.

In the embodiment of FIG. 2 the ship 2 is moored to a buoy, comprising a cylindrical body 9, with two rigidly thereto connected arms 10 and 11, of which the ends 12 and 13 are secured to connection means 14 and 15 respectively, which connection means may be embodied as cables, chains or rods and of which the upper ends are at 16 and 17 connected to the ship 2.

Between the arms a connecting element 18 is installed bearing a rotatable rim or turntable 19 carrying the anchor chains 20. Said anchor chains comprise the weight acting on the arms 10 and 11, putting the connection means 14 and 15 under tensile stress and therefore creating the reset force component.

Figure 4:
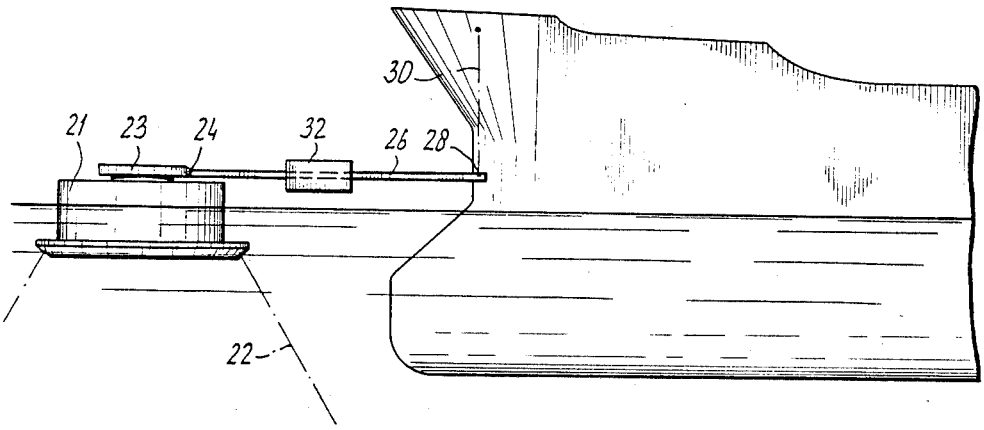
FIG. 4 is a side-view of a further embodiment.
Figure 5:
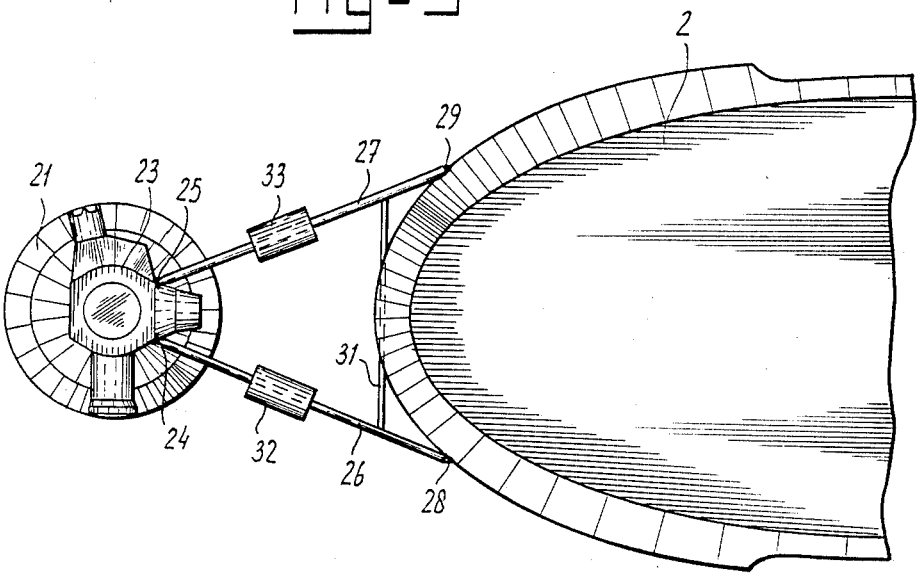
FIG. 5 is the corresponding top-view.

In the embodiment illustrated in FIGS. 4 and 5 a normal buoy 21 is used fastened to anchor chains 22 and carrying a turntable 23. Arms 26 and 27 are attached to said turntable through ball joints or flexible joints, i.e. joints which have at least a horizontal pivot shaft, and which are indicated by 24 and 25, and the ends 28, 29 of said arms are again through a connection means 30 carried by the ship 2.

If desired, a flexible distance element 31 can be installed between said arms.

The arms 26, 27 carry weights 32, 33 which if desired may be embodied as cylinders, which are displaceable lengthwise of arms 26, 27.

Figure 6:
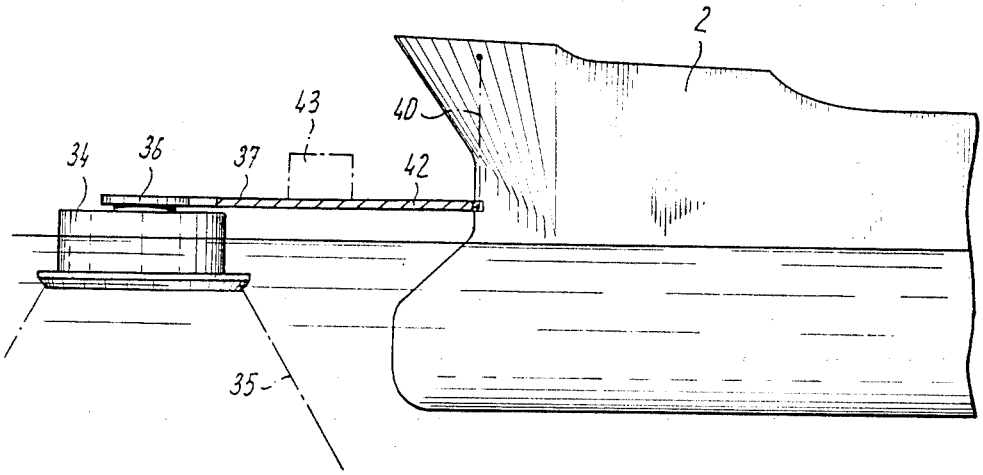
FIG. 6 is a side-view of a further embodiment.
Figure 7:
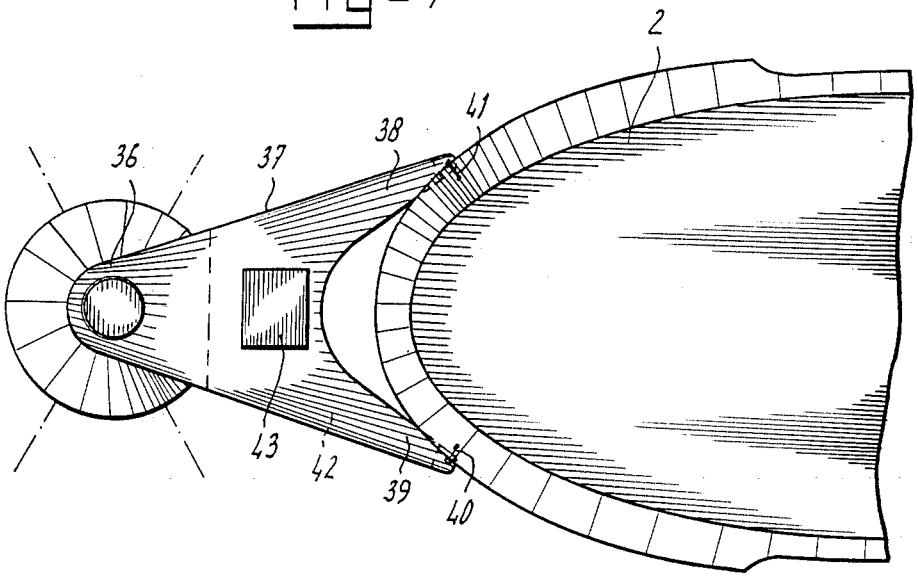
FIG. 7 is the thereto corresponding top-view.

In the embodiment of FIGS. 6 and 7 a buoy 34 is used fastened by means of anchor chains 35 and carrying a turntable 36 integrated to the arm 37, which is bifurcated in two ends 38 and 39, suspended through the connection means 40 respectively 41 from the ship. Said arm 37 may be embodied as a hollow arm with a ballast space 42 and if necessary an additional weight 43 can be installed on said arm.

Figure 8:
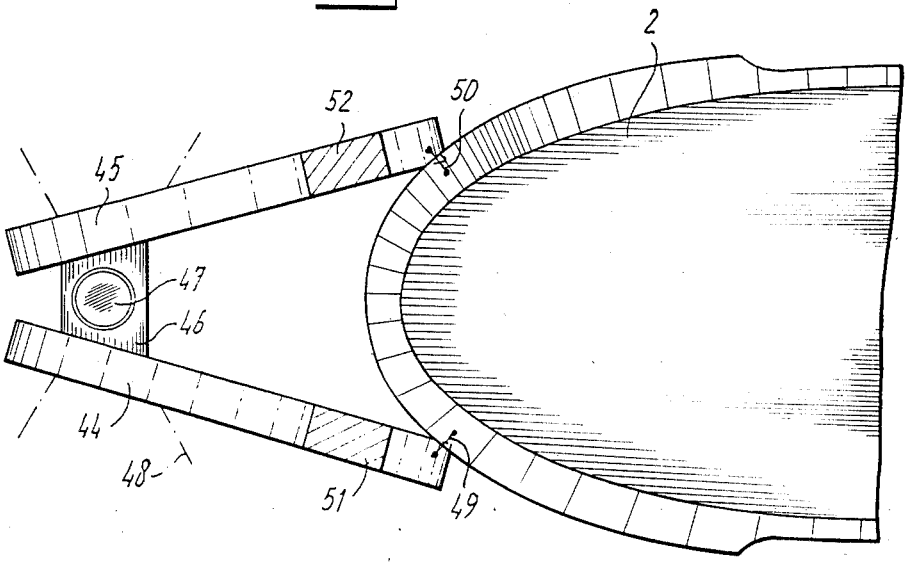
FIG. 8 is a top-view of another embodiment.

The embodiment of FIG. 8 illustrates a buoy comprising of two buoyant bodies 44, 45 with a connecting element 46 installed inbetween together with the turntable 47 for the anchor chains 48. The ends of said arms 44, 45 are also in this case attached to the ship 2 through connection means 49, 50. Said arms comprise ballast spaces 51, 52 for generating the reset forces.

I claim:

1. In a mooring system for maintaining a vessel on the surface of a body of water in a position in relation to a body which is secured to the bottom of the body of water, which mooring system comprises a rigid arm attached at one end of the arm to said body for hoizontal swinging movement relative to said body about a vertical axis, said arm having its other end movably suspended by connecting means which are suspended from the vessel, and a weight directly attached to the arm; the improvement in which said connecting means comprise at least one elongated member directly connected to the vessel at its upper end, said rigid arm and said weight and the point of suspension of said other end of said arm from said connecting means being disposed at least as high as said surface of said body of water, said arm and said vessel being movable horizontally relative to each other, the weight urging said vessel to move horizontally toward a position in which the connecting means above the arm is vertical.

2. System according to claim 1, in which said body is a buoy anchored to the bottom of the body of water by anchor chains, and an anchor chain turntable rotatable relative to said buoy and connected to said rigid arm.

3. System according to claim 1, in which the arm is above the surface of the body of water.

4. System according to claim 1, in which the weight is above the surface of the body of water.

5. System according to claim 1, said arm being in two portions and said weight being in two portions, one said weight portion being directly connected to each said arm portion.

6. System according to claim 1, in which at least one of said arm and weight is a body which can be filled with ballast water and can be emptied.

* * * * *